US005184818A

United States Patent [19]

Lo

[11] Patent Number: 5,184,818

[45] Date of Patent: Feb. 9, 1993

[54] METAL RACKET

[76] Inventor: Kun-Nan Lo, No. 33, Hsiang-Ho Rd., Li-Lin Tsun, Tan-Tzu Hsiang, Taichung Hsien, Taiwan

[21] Appl. No.: 792,117

[22] Filed: Nov. 14, 1991

[51] Int. Cl.[5] ..... A63B 49/12

[52] U.S. Cl. ..... 273/73 H; 273/73 R; 273/73 C

[58] Field of Search ..... 273/73 R, 73 C, 73 H

[56] References Cited

U.S. PATENT DOCUMENTS

| | | | |
|---|---|---|---|
| 3,752,478 | 8/1973 | Flak | 273/73 H |
| 4,280,699 | 7/1981 | Drake | 273/73 H |
| 4,365,806 | 12/1982 | Reid et al. | 273/73 C |
| 4,614,341 | 9/1986 | Fernandez | 273/73 C |
| 4,834,383 | 5/1989 | Woehrle et al. | 273/73 C |
| 4,913,434 | 4/1990 | Fischer | 273/73 C |

*Primary Examiner*—V. Millin
*Assistant Examiner*—Raleigh W. Chiu
*Attorney, Agent, or Firm*—Panitch, Schwarze, Jacobs & Nadel

[57] ABSTRACT

A metal racket includes a hollow looped head portion having a cross-section lying on a plane perpendicular to a string web held by the looped head portion. The cross-section includes a convex outer periphery with two terminating ends disposed on opposite sides of the string web, a first axis perpendicular to the string web and passing through the terminating ends of the outer periphery, and an inner periphery opposite to the outer periphery and having two flat portions extending inwardly from a respective terminating end of the outer periphery and disposed along the first axis. The inner periphery further has an inner convex portion disposed between and interconnecting the flat portions. The cross-section has an axis of symmetry extending along the string web and perpendicular to the first axis. The axis of symmetry passes through a first point on the inner convex portion. The outer periphery has a central portion divided by the axis of symmetry at a second point. The central portion is indented to form a peripheral groove aligned with the inner convex portion. The second point is a point on the central portion before the central portion was indented. The distance of the first point from the first axis is shorter than that of the second point from the first axis.

2 Claims, 6 Drawing Sheets

METAL RACKET

BACKGROUND OF THE INVENTION

1. Field of the Invention

The invention relates to a metal racket, more particularly to a metal racket having a wider ball striking area compared to a racket with a looped head portion of the same size outer periphery and a frame having an oblongated cross-section to permit better ball control.

2. Description of the Related Art

There are two types of metal rackets presently available. The looped head portion (1) of a first type of conventional metal racket is shown in FIG. 1 to be made of an extruded metal tube having a cross-section that includes a pair of substantially triangular loop portions (2) and a flat connecting portion (3) bridging the loop portions (2). String holes are punched in the connecting portion (3) before the metal tube is bent so as to form the looped head portion (1). The manufacturing cost of the above described metal racket is relatively low because of the simple machining steps involved.

Although the above disclosed metal racket is low cost and is easy to construct, it has the following disadvantages:

(a) Unsightly peripheral grooves (4, 5) are formed on two sides of the connecting portion (3). The market value of the metal racket is thus affected because of the appearance of "inferior quality."

(b) The metal racket is less durable. Referring to FIG. 2, the connecting portion (3) curves inwardly when the striking impact of a ball is relatively strong. This results in poor ball control and in the eventual deformation of the metal racket.

Referring to FIG. 3, the looped head portion (6) of a second type of conventional metal racket is made of an extruded metal tube which has a substantially oblongated cross-section. The looped head portion (6) has a convex inner periphery (61) and a convex outer periphery opposite to the convex inner periphery (62). Since the looped head portion (6) does not have unsightly peripheral grooves similar to those of the looped head portion (1), the metal racket is therefore more durable and has a "high quality" appearance. The looped head portion (6) is further provided with a pair of spaced reinforcing ribs (7) which bridge the inner and outer peripheries (61, 62). The ribs (7) enhance the durability of the metal racket.

Because the cross-section of the looped head portion (6) is wider than that of the looped head portion (1), the ball striking area defined by the looped head portion (6) is correspondingly smaller. Referring to FIG. 4, a string web (8) of longitudinal and transverse string lines is held by the looped head portion (6). The longitudinal string lines are normally longer than the transverse string lines. The direction of ball rebound generally depends upon the striking point of the ball on the string web (8). It is easy to predict the direction of ball rebound when the ball strikes a point (Pl) on the string web (8), the point (Pl) being the center of symmetry of the looped head portion (6). The ball will generally be rebounded in a direction perpendicular to the string web (8) without any angular deviation when it strikes the string web (8) at the point (Pl).

The direction of ball rebound becomes more difficult to predict when the ball impacts points farther from the center of symmetry (Pl). This is because both the longitudinal and transverse string lines are bisected into segments of unequal length, thus causing the string lines to deflect at different angles with respect to the string web (8).

Referring to FIGS. 4, 5A and 5B, the impact points (P2) and (P3) are on different longitudinal lines (AA) and (BB) but are on the same transverse line (CC). The line (BB) is longer than the line (AA) and thus the line (AP2) is shorter than the line (BP3). The deflection angle (Θ2) of a ball rebounded from the longer string line (BB) is therefore smaller than the deflection angle (Θ1) of a ball rebounded from the shorter string line (AA).

Referring to FIGS. 4, 5C and 5D, the impact points (P2) and (P4) are on different transverse lines (CC) and (DD) but are on the same longitudinal line (AA). The line (DD) is longer than the line (CC) and thus the line (CP2) is shorter than the line (DP4). The deflection angle (Θ4) of a ball rebounded from the longer line (DD) is therefore smaller than the deflection angle (Θ3) of a ball rebounded from the shorter line (CC).

In view of the foregoing discussion, it can be concluded that the deflection angle of the ball is smaller when the string line is longer. In order to achieve better ball control, it is desirable to minimize the deflection angles of the string lines. To this end, it is necessary to lengthen the string lines and correspondingly increase the ball striking area.

SUMMARY OF THE INVENTION

Therefore, the main objective of the present invention is to provide a durable metal racket having an improved looped head portion with a wider ball striking area compared to a racket with a looped head portion of the same size outer periphery and a frame having an oblongated cross-section so as to achieve better ball control.

Accordingly, the preferred embodiment of a metal racket of the present invention includes a hollow looped head portion and a string web held by the looped head portion. The looped head portion has a cross-section lying on a plane perpendicular to the string web. The cross-section includes a convex outer periphery with two terminating ends disposed on opposite sides of the string web, a first axis perpendicular to the string web and passing through the terminating ends of the outer periphery, and an inner periphery opposite to the outer periphery and having two flat portions extending inwardly from a respective terminating end of the outer periphery and disposed along the first axis. The inner periphery further has an inner convex portion disposed between and interconnecting the flat portions. The cross-section has an axis of symmetry extending along the string web and perpendicular to the first axis. The axis of symmetry passes through a first point on the inner convex portion. The outer periphery has a central portion divided by the axis of symmetry at a second point. The central portion is indented to form a peripheral groove aligned with the inner convex portion. The second point is a point on the central portion before the central portion was indented. The distance of the first point from the first axis is shorter than that of the second point from the first axis. The inner convex portion of the inner periphery and the central portion of the outer periphery are formed with a plurality of string holes to hold the string web. A pair of spaced reinforcing ribs project inwardly from two ends of the convex portion in the direction of the axis of symmetry in order to bridge the inner and outer peripheries. The metal racket is durable and has a wider ball striking area to ensure better ball control.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 6:
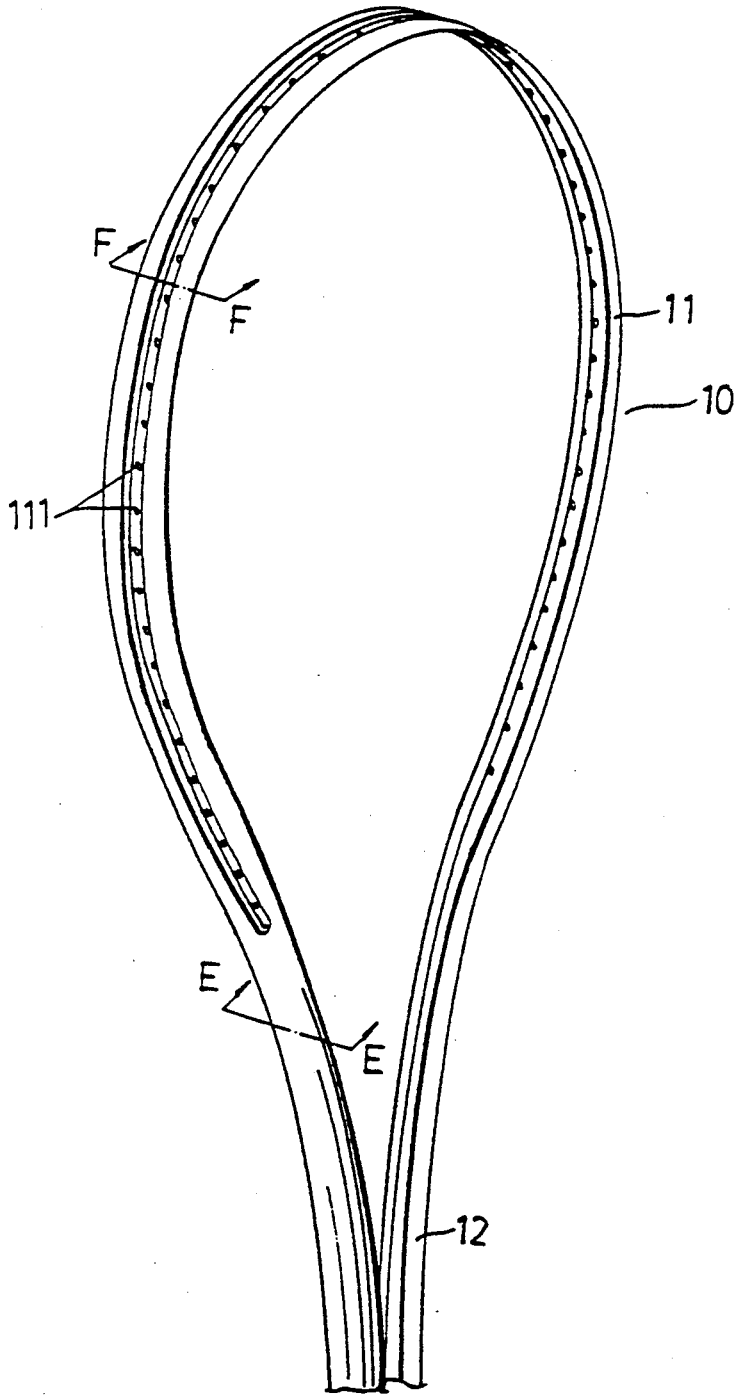
FIG. 6 is a perspective view of the looped head portion of the preferred embodiment of a metal racket according to the present invention.
Figure 9:
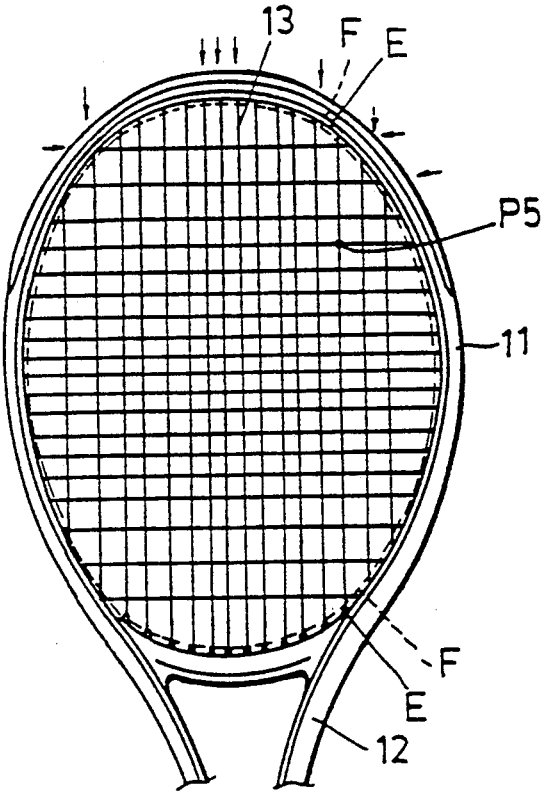
FIG. 9 is a front view of the racket head of the preferred embodiment.

Referring to FIG. 6, the preferred embodiment of a metal racket according to the present invention is shown to comprise a hollow racket frame (10) made of a lightweight, extruded aluminum alloy tube. The racket frame (10) has a looped head portion (11) connected to a handle portion (12). The looped head portion (11) is formed with a plurality of string holes (111) to hold a string web (13) of longitudinal and transverse string lines (as shown in FIG. 9). A grip (not shown) is connected to the handle portion (12) to complete the metal racket of the present invention.

Figure 7:
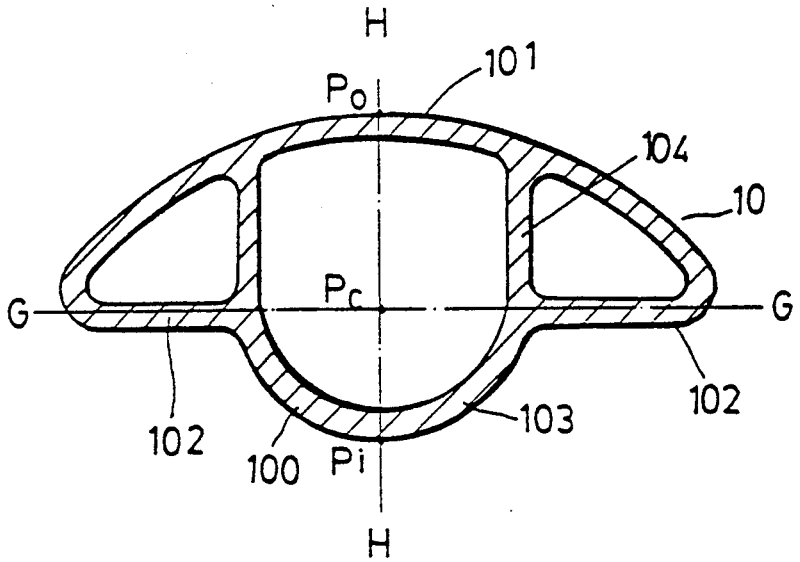
FIG. 7 is an E—E section of the metal racket shown in FIG. 6.

An E—E section of the metal racket is shown in FIG. 7. The racket frame (10) has a smooth convex outer periphery (101) that provides the preferred embodiment with a "high quality appearance." An axis G—G passes through the two terminating ends of the outer periphery (101). The inner periphery (100) of the racket frame (10) includes two flat portions (102), each of which extends inwardly from a respective one of the terminating ends of the outer periphery (101) and is disposed along the axis G—G. The inner periphery (100) of the racket frame (10) is further provided with an inner convex portion (103) disposed between and interconnecting the flat portions (102). The cross-section of the racket frame (10) is symmetrical relative to an axis H—H which is perpendicular to the axis G—G. The axis H—H passes through a point (Po) on the outer periphery (101) and through a point (Pi) on the inner convex portion (103). The distance of the point (Po) from the axis G—G is longer than the distance of the point (Pi) from the same axis G—G. [Line PoPc is longer than line PiPc]. A pair of spaced reinforcing ribs (104) project inwardly from two ends of the inner convex portion (103) to bridge the inner and outer peripheries, (100) and (101). The ribs (104) enhance the durability of the metal racket.

Figure 8:
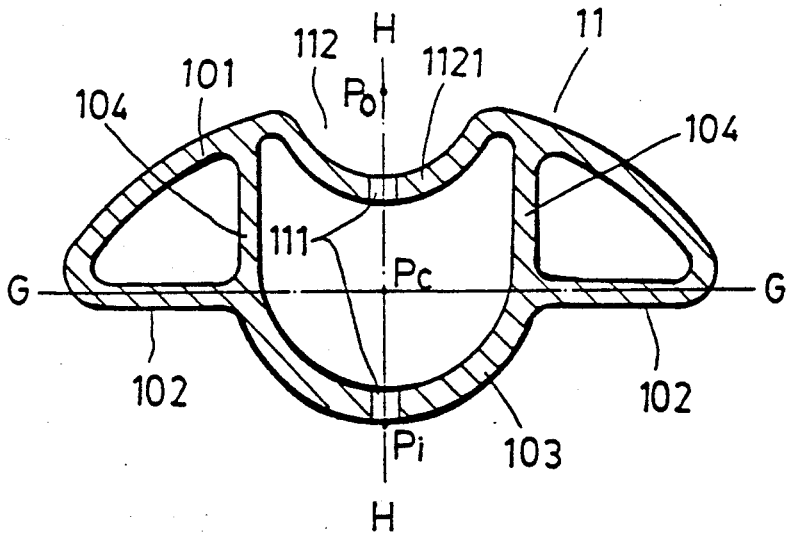
FIG. 8 is an F—F section of the metal racket shown in FIG. 6.

A cross-section of the looped head portion (11) taken along a plane (F—F) perpendicular to the string web is shown in FIG. 8. Referring to FIGS. 6, 8 and 9, the axis G—G is perpendicular to the string web (13), while the axis H—H extends along the string web (13). The outer periphery (101) has a central portion (112) divided by the axis H—H at the point (Po). The central portion (112) is indented when forming the looped head portion (11) to form thereby a peripheral groove (1121) that is aligned with the inner convex portion (103). A plurality of string holes (111) are punched in the central portion (112) and the inner convex portion (103) to hold the string web (13).

Referring to FIG. 9, the ribs (104) enhance the durability of the metal racket of the present invention by absorbing some of the impact force transmitted to the racket frame (10). [The lines of force which are produced when the web (13) is struck are indicated by the arrow lines]. The dotted lines in FIG. 9 indicate the projection of the convex inner periphery of the conventional metal racket shown in FIGS. 3 and 4. Note that the ball striking area of the present invention is wider than that of the prior art, and that the lengths of the string lines of the present invention are longer than those of the above indicated prior art.

Figure 1:
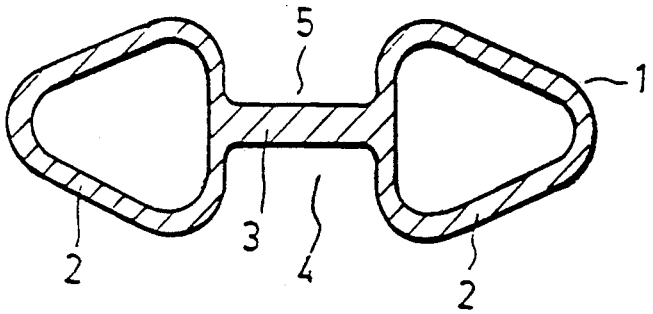
FIG.1 PRIOR ART
FIG. 1 is a sectional view of the looped head portion of a first type of conventional metal racket.
Figure 2:
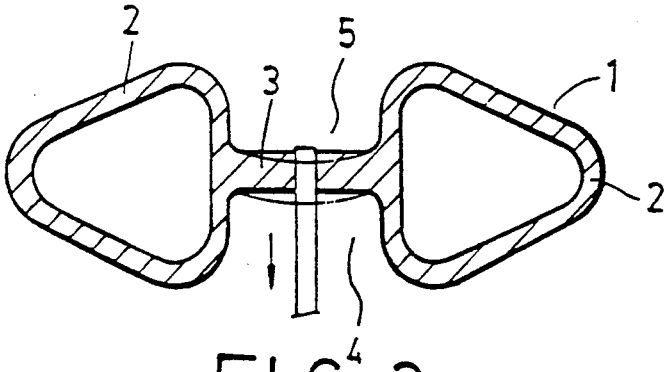
FIG.2 PRIOR ART
FIG. 2 is a sectional view of the looped head portion shown in FIG. 1 when in use.
Figure 3:
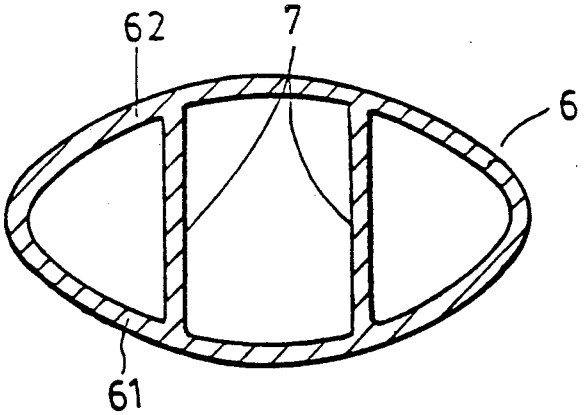
FIG.3 PRIOR ART
FIG. 3 is a sectional view of the looped head portion of a second type of conventional metal racket.
Figure 4:
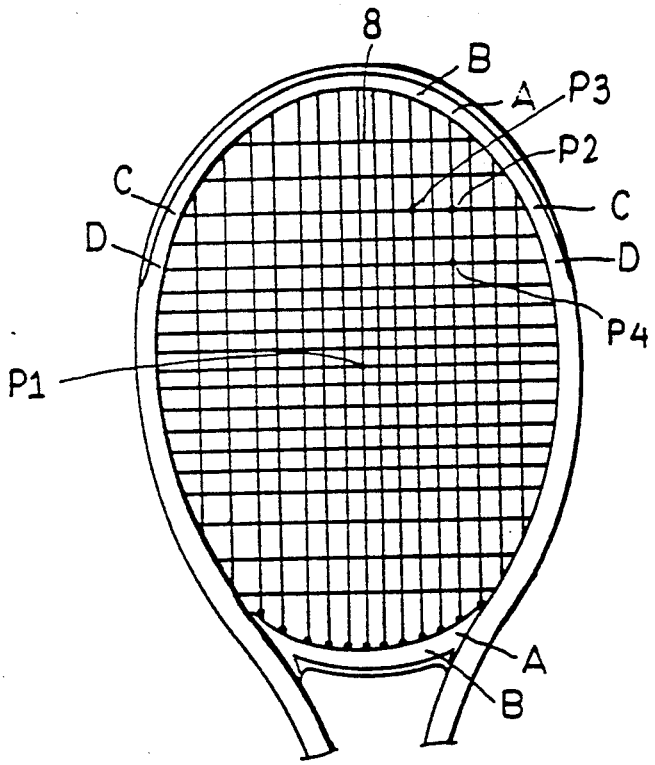
FIG. 4 PRIOR ART
FIG. 4 is a front view of the metal racket shown in FIG. 3.
Figure 5A:
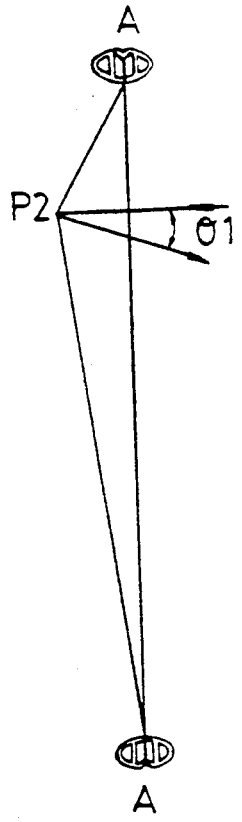
FIG.5A PRIOR ART
FIGS. 5A to 5D illustrate the deflection of the string lines of the metal racket shown in FIG. 4 when impacted by a ball at three different points.
Figure 5B:
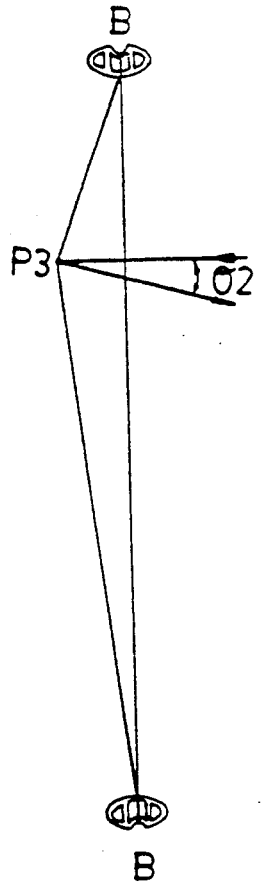
FIG.5B PRIOR ART
Figure 5C:
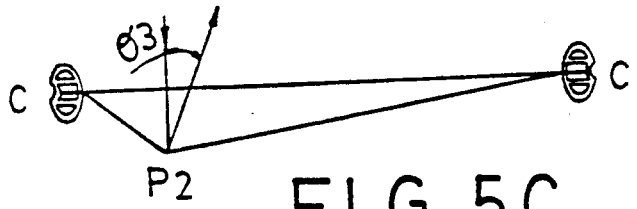
FIG.5C PRIOR ART
Figure 5D:
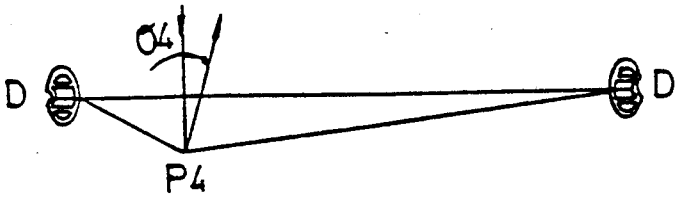
FIG.5D PRIOR ART
Figure 10A:
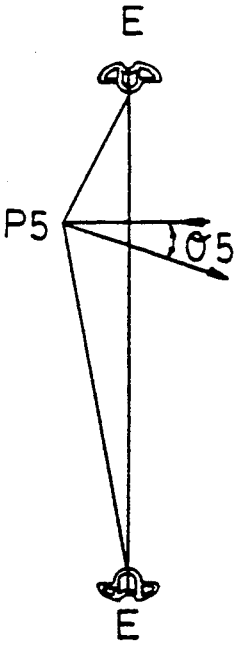
FIGS. 10A and 10B compare the deflection of the string lines of the present invention with those of the prior art.
Figure 10B:
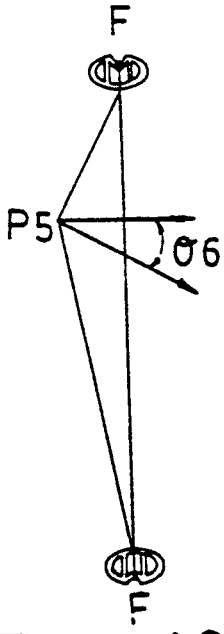
FIG.10B PRIOR ART

FIGS. 10A and 10B compare the deflection of the string lines of the metal racket of the present invention with those of the prior art as shown in FIGS. 3 and 4. A longitudinal line (EE) on the looped head portion (11) of the present invention is shown to be longer than a similarly positioned longitudinal line (FF) on the looped head portion of the above indicated conventional metal racket. Referring to FIG. 10A, a ball striking the string web (13) at an impact point (P5) which is on the longitudinal line (EE) of the looped head portion (11) will be rebounded at a deflection angle (Θ5). Referring to FIG. 10B, a ball striking the string web of a conventional metal racket at the same impact point (P5) which is on the longitudinal line (FF) of the looped head portion of the conventional metal racket will be rebounded at a deflection angle (Θ6). The deflection angle (Θ5) of a ball rebounded from the longer line (FF) is therefore smaller than the deflection angle (Θ6) of a ball rebounded from the shorter line (EE).

The advantages of using the metal racket of the present invention are as follows:

1. The racket frame has a smooth convex outer periphery which enhances the aesthetic appeal of the metal racket.

2. The metal racket is durable and has a wider ball striking area compared to a racket with a looped head portion of the same size outer periphery and a frame having an oblongated cross-section to ensure better ball control.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A metal racket including a hollow looped head portion and a string web held by said looped head portion, characterized by:

said looped head portion having a cross-section lying on a plane perpendicular to said string web; said cross-section including a convex outer periphery with two terminating ends disposed on opposite sides of said string web, a first axis perpendicular to said string web and passing through said terminating ends of said outer periphery, and an inner periphery defining a ball striking area, said inner periphery being opposite to said outer periphery and having two flat portions, each of said flat portions extending inwardly from a respective one of said terminating ends of said outer periphery and being disposed along said first axis; said inner periphery further having an inner convex portion disposed between and interconnecting said flat portions; said cross-section having an axis of symmetry extending along said string web and perpendicular to said first axis; said axis of symmetry passing through a first point on said inner convex portion; said outer periphery having a central portion divided by said axis of symmetry at a second point; said central portion being indented to form an outer peripheral concave groove aligned with said inner convex portion; said second point being a point on said central portion before said central portion was indented; the distance of said first point from said first axis being shorter than that of said second point from said first axis; and said inner convex portion of said inner periphery and said central portion of said outer periphery being formed with a plurality of string holes to hold said string web.

2. The metal racket as claimed in claim 1, further comprising a pair of spaced reinforcing ribs projecting inwardly from two ends of said convex portion in the direction of said axis of symmetry to bridge said inner and outer peripheries.

* * * * *